United States Patent [19]

Tanaka

[11] Patent Number: 4,621,197

[45] Date of Patent: Nov. 4, 1986

[54] MULTI-FUNCTION STARTER

[75] Inventor: Toshinori Tanaka, Himeji, Japan

[73] Assignee: Mitsubishi Denki Kabushiki Kaisha, Tokyo, Japan

[21] Appl. No.: 669,371

[22] Filed: Nov. 8, 1984

[30] Foreign Application Priority Data

Nov. 10, 1983 [JP] Japan ..... 58-175356[U]

[51] Int. Cl.[4] ..... F02N 15/06

[52] U.S. Cl. ..... 290/38 R; 290/48; 318/4

[58] Field of Search ..... 290/38 R, 38 A, 48; 318/4; 123/179 R

[56] References Cited

U.S. PATENT DOCUMENTS

| | | | |
|---|---|---|---|
| 2,414,602 | 1/1947 | Mott | 318/4 X |
| 3,991,734 | 11/1976 | Martin | 123/179 E |
| 4,481,424 | 11/1984 | Hattori et al. | 290/38 R |
| 4,559,455 | 12/1985 | Tanaka | 318/4 X |

FOREIGN PATENT DOCUMENTS

| | | |
|---|---|---|
| 3121058 | 5/1981 | Fed. Rep. of Germany . |
| 57-101370 | 6/1982 | Japan . |

*Primary Examiner*—William M. Shoop, Jr.
*Assistant Examiner*—W. E. Duncanson, Jr.
*Attorney, Agent, or Firm*—Oblon, Fisher, Spivak, McClelland & Maier

[57] ABSTRACT

A multi-function starter comprises a prime shaft to be rotated by a driving means and having a cylindrical recess at its one end, a pinion to be rotated by the prime shaft thereby driving a ring gear of an engine, an intermediate shaft being slidable in the axial direction to be fitted into the cylindrical recess of the prime shaft for rotation along with the prime shaft and an actuating means for moving the intermediate shaft in the axial direction to selectively engage a gear wheel fitted to the intermediate shaft with a gear wheel for an auxiliary load device.

6 Claims, 2 Drawing Figures

MULTI-FUNCTION STARTER

BACKGROUND OF THE INVENTION

1. Field of the Invention

The present invention relates to a multi-function starter for driving different kind of devices such as both an engine for a car and an auxiliary load device, e.g. a pump mounted on the car.

2. Description of Prior Art

FIG. 1 shows a conventional multi-function starter disclosed, for instance, in Japanese Unexamined Utility Model Publication No. 152840/1980. In FIG. 1, a ring gear 3 is secured at the outer circumferential surface of an end part of a flywheel 2 which is connected at an end of the crank shaft 1 of an internal combustion engine (not shown). A gear wheel 5 is placed in parallel to the ring gear 3 and is connected to a pump device (now shown) used as an auxiliary load device through an rotary shaft 4. A starter motor 6 connected to a battery 11 has an output shaft 6*a* at the end of which a pinion 7 is placed so as to be slidable in the axial direction. The pinion 7 is moved in the axial direction to be engaged with the ring gear 3 or the gear wheel 5 by means of a shift lever 8 which is operated by actuation of an electromagnetic switch 9. A reference numeral 9*a* designates an exciting coil of the electromagnetic switch 9. In a line connecting between the battery 11 and the starter motor 6, a contact 10 operated in association with the electro-magnetic switch 9 is provided. A relay switch 12 has a contact 12*a* connected between the battery 11 and the starter motor 6 in parallel to the contact 10 and has an exciting coil 12*b* for opening and closing the contact 12*a*.

There is provided a contact 14 whose one terminal is connected to the battery 11 through a fuse 13 and whose other terminal is connected to the exciting coil 12*b* through a contact 16. One terminal of a contact 15 is connected to the contact 14 and the other is grounded through the exciting coil 9*a*.

The operation of the conventional multi-function starter will be described.

For starting of the internal combustion engine, both the contacts 14, 15 are closed to actuate the electromagnetic switch 9 whereby the pinion 7 is interlocked with the ring gear 3 through the shift lever 8. At the same time, the contact 10 is closed and revolution of the starter motor 6 causes starting of the engine through output shaft 6*a*, the pinion 7, the ring gear 3, the flywheel 2 and the crank shaft 1. After starting of the engine, the contact 15 is opened and the electromagnetic switch 9 is deenergized. Then, the pinion 7 is disengaged from the ring gear 3 through the movement of the shift lever 8 and is engaged with the gear wheel 5, while the contact 10 is opened to stop the starter motor 6.

When the pump has to be driven, the contact 16 is closed, hence the contact 12*a* of the relay switch 12 is closed thereby actuating the starter motor 6 with the result of driving the pump through the output shaft 6*a*, the pinion 7, the gear wheel 5 and the rotary shaft 4.

In the conventional multi-function starter having the construction as above mentioned, the pinion 7 is engaged with either the ring gear 3 of the engine or the pump as an auxiliary load device to drive it. Accordingly, there takes place an abnormal wearing of the pinion 7. This results in incomplete engagement of the ring gear 3 with the gear wheel 5 for the auxiliary load device thereby causing generation of high level noises and reduction in torque transmitting characteristic.

SUMMARY OF THE INVENTION

It is an object of the present invention to provide a multi-function starter of a small size which minimizes wearing of a pinion and has excellent torque transmitting characteristic and which is usable for a long time.

The foregoing and the other objects of the present invention have been attained by providing a multi-function starter comprising a prime shaft to be rotated by a driving means and having a cylindrical recess at its one end, a pinion to be rotated by the prime shaft thereby driving a ring gear of an engine, an intermediate shaft being slidable in the axial direction to be fitted into the cylindrical recess of the prime shaft for rotation along with the prime shaft and means for moving said intermediate shaft which moves said intermediate shaft in the axial direction to selectively engage a gear fitted to the intermediate shaft with an auxiliary load device.

DESCRIPTION OF PREFERRED EMBODIMENT

Figure 2:
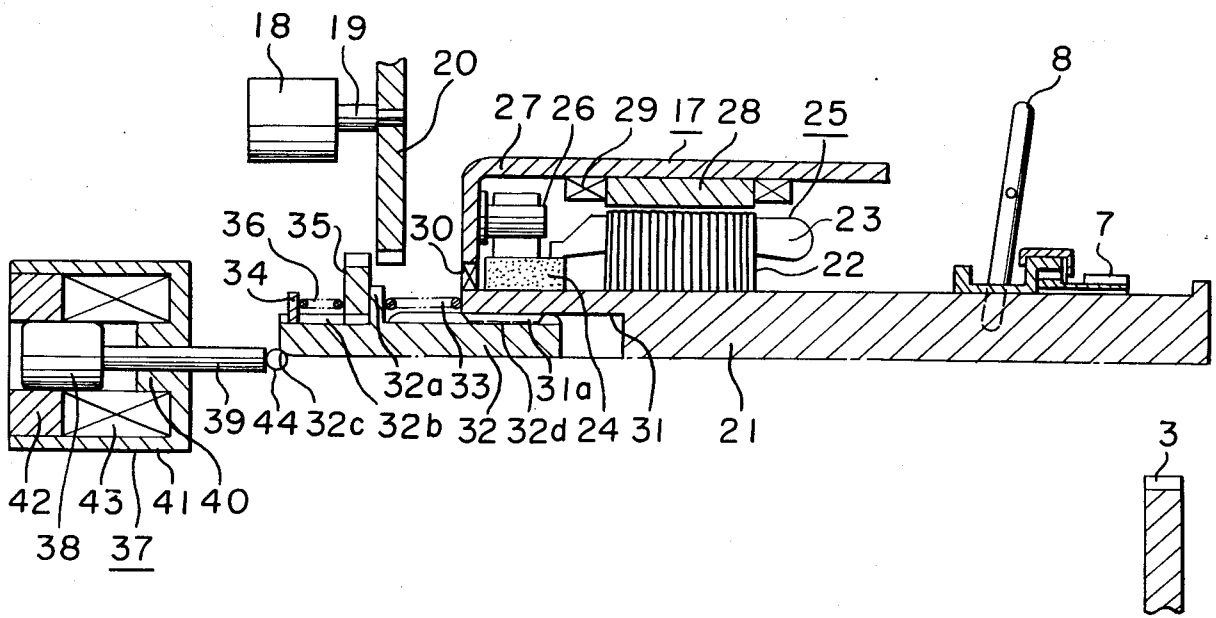
FIG. 2 is a cross-sectional view partly omitted of an embodiment of the multi-function starter according to the present invention.

An embodiment of the multi-function starter of the present invention will be described with reference to FIG. 2.

A d.c. motor 17 constituting a multi-function starter comprises an armature 25 which consists of a prime shaft 21, an armature iron core 22 fixed to the prime shaft 21, armature coils 23 fitted in the slots (now shown) formed in the armature iron core 22, and a commutator 24 fixed to the prime shaft 21. A reference numeral 18 designates a pump as an auxiliary load device having a rotary shaft 19 to which a large gear wheel 20 is fixed. A brush device 26 is attached to a machine frame 27 so as to be in slide-contact with the commutator 24. The machine frame 27 is attached with, on the inner surface, magnetic poles 28 around which field coils 29 are arranged. The prime shaft 21 is rotatably supported by the machine frame 27 through a ball bearing 30. A cylindrical recess 31 is formed at an end of the prime shaft 21 and a helical spline 31*a* is formed in the inner circumferential surface of the cylindrical recess 31. An intermediate shaft 32 is adapted to be movable in the axial direction of the prime shaft 21 and has a helical spline 32*d* which is engagable with the spline 31*a* formed in the cylindrical recess 31 of the prime shaft 21 whereby it is rotated along with the prime shaft 21. The intermediate shaft 32 is also provided with a flange 32*a* at its middle portion, a spline 32*b* and a recess 32*c* formed at the central portion of the end surface in the opposite to the prime shaft 21. A coil spring 33 is extended between the flange 32*a* of the intermediate shaft 32 and an end of the prime shaft 21 to press the intermediate shaft 32 on the left hand in FIG. 2. A snap ring 34 is fitted to the end part of the intermediate shaft 32 and a gear wheel 35 is provided between the flange 32*a* and the snap ring 34 and is engaged with the spline 32*b* so as to be movable in the axial direction and rotatable together with the intermediate shaft 32. A coil spring 36 is extended between the snap ring 34 and the gear wheel 35 to press the gear wheel 35 in the right direction in FIG. 2. There is provided an electromagnetic switch 37 as an actuating means for moving the intermediate shaft 32. The electromagnetic switch 37 comprises a movable iron core 38, a rod 39 connected to the movable iron core 38, a stationary iron core 40, a yoke 41, a magnetic flange 42 and a solenoid coil 43 for actuating the movable iron core 38. A steel ball 44 is interposed between the recess 32*c* formed at end surface of the intermediate shaft 32 and the rod 39 of the electromagnetic switch 37 to bear a pressing force of the rod 39. The other construction is the same as that of the conventional device as in FIG. 1 and therefore, the description is omitted.

The operation of the multi-function starter of the present invention will be described.

Figure 1:
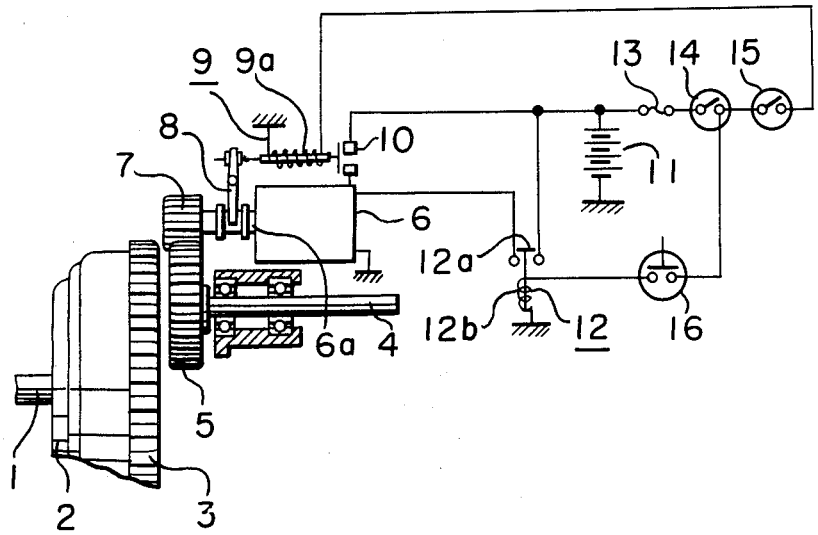
FIG. 1 is a schematic diagram of a conventional multi-function starter.

Description as to the way of starting the engine is omitted since it is the same as that of the conventional device as shown in FIG. 1. When the pump 18 as an auxiliary load device is to be driven after starting of the engine, the coil 43 of the electromagnetic switch 37 is energized by current conduction whereby the movable iron core 38 is attracted to the stationary iron core 40. The resulted attractive force is transmitted to the intermediate shaft 32 through the rod 39 and the steel ball 44. Then, the intermediate shaft 32 is brought into engagement with the helical spline 31*a* formed in the cylindrical recess 31 of the prime shaft 21 to be turned according to helical grooves in the helical structure and moved on the right hand in FIG. 2. The movement of the intermediate shaft 32 causes engagement of the gear wheel 35 with the large gear wheel 20. At the same time, only the d.c. motor 17 is actuated by current conduction and a rotational force of the armature 25 is transmitted to the large gear wheel 20 through the intermediate shaft 32 engaged with the prime shaft 21 by means of the spline structure and the gear wheel 35 engaged with the intermediate shaft 32 by means of the spline structure; thus, the pump 18 is driven.

There may take place that the end surfaces of the teeth of the gear wheel 35 are in contact with the end surfaces of the teeth of the large gear wheel 20 to hinder engagement of the gear wheel 35 with the large gear wheel 20 at the time of the movement of the intermediate shaft 32 in the right direction. In this case, the coil spring 36 extending between the snap ring 34 and the gear wheel 35 is compressed to thereby push the gear wheel 35 toward the large gear wheel 20 for increasing a contacting force. Then, when a rotational force is generated by actuation of the armature 25, the gear wheel 35 is brought into engagement with the large gear wheel 20. Further, helical movement of the intermediate shaft 32 caused by the helical splines 31*a* and 32*d* when the intermediate shaft 32 is inserted into the cylindrical recess 31 of the prime shaft 21 facilitates engagement of the gear wheel 35 with the large gear wheel 20.

In the foregoing embodiment, a d.c. motor 17 is used as a driving device. However, it is possible to use a driving device actuated by another principle such as a hydraulic motor, an air turbine etc. For a starter, a multi-function starter provided with an internal speed reduction mechanism may be used. An auxiliary load device may be a rotating machine other than a pump 18 and an electromagnetic switch 37 may be replaced by a cylinder-operated actuater utilizing hydraulic pressure.

As described above, the multi-function starter of the present invention is constructed in such a manner that a pinion is rotated by a prime shaft of the starter to drive an ring gear of an engine; an intermediate shaft is arranged in the same axial line as the prime shaft so that the intermediate shaft is movable along the axial line to be fitted in the cylindrical recess formed at an end of the prime shaft and being rotatable together with the prime shaft; and an auxiliary load device is selectively driven by a gear wheel provided on the intermediate shaft. Accordingly, there is obtainable a multi-function starter minimizing wearing of a pinion caused by engagement, being excellent in torque transmitting characteristic and having a prolonged life time. Particularly, wearing of the gear wheel of the intermediate shaft is small because it is used only when the auxiliary load device is driven.

In accordance with the present invention, the size of the multi-function starter is reduced because the intermediate shaft is so arranged that it is inserted in the cylindrical recess of the prime shaft to reduce the length of the device in the axial direction.

What is claimed:

1. A multi-function starter which comprises a prime shaft to be rotated by a driving means and having a cylindrical recess at its one end, a pinion to be rotated by said prime shaft thereby driving a ring gear of an engine, an intermediate shaft being slidable in the axial direction to be fitted into said cylindrical recess of said prime shaft for rotation along with the prime shaft and an actuating means for moving said intermediate shaft in the axial direction to selectively engage a gear wheel fitted to said intermediate shaft with a gear wheel for an auxiliary load device.

2. The multi-function starter according to claim 1, wherein said prime shaft and said intermediate shaft is connected by a helical spline structure formed in the inner circumferential surface of the cylindrical recess of said prime shaft and the outer circumferential surface of said intermediate shaft.

3. The multi-function starter according to claim 1, wherein said intermediate shaft is provided with a flange and a snap ring in which a gear wheel is mounted on the intermediate shaft so as to be slidable in the axial direction by means of a spline structure and a coil spring extends between said gear wheel and said snap ring.

4. The multi-function starter according to claim 1, wherein said prime shaft, said intermediate shaft and said actuating means are arranged in a single and the same axial line.

5. The multi-function starter according to claim 1, wherein said actuating means is an electromagnetic switch.

6. The multi-function starter according to claim 5, wherein a coil spring is interposed between said prime shaft and said intermediate shaft to return said intermediate shaft when said electromegnetic switch is deenergized.

* * * * *